US007238107B2

(12) United States Patent
McVay, III

(10) Patent No.: US 7,238,107 B2
(45) Date of Patent: Jul. 3, 2007

(54) CONSONANT PAIN

(76) Inventor: Julian Clyde McVay, III, 2416 Princess Ct., Carrollton, TX (US) 75006

( * ) Notice: Subject to any disclaimer, the term of this patent is extended or adjusted under 35 U.S.C. 154(b) by 654 days.

(21) Appl. No.: 10/672,516

(22) Filed: Sep. 29, 2003

(65) Prior Publication Data

US 2005/0070350 A1 Mar. 31, 2005

(51) Int. Cl.
*A63F 9/24* (2006.01)
*A63F 13/00* (2006.01)

(52) U.S. Cl. ..... 463/7

(58) Field of Classification Search ..... None
See application file for complete search history.

(56) References Cited

U.S. PATENT DOCUMENTS 4,055,348 A * 10/1977 Marzoni, Jr. ..... 273/146
5,316,482 A * 5/1994 Bryson ..... 434/129
6,824,136 B2 * 11/2004 Koopman ..... 273/146
2003/0201601 A1 * 10/2003 Koopman ..... 273/146

FOREIGN PATENT DOCUMENTS

FR 2224186 A * 12/1974

* cited by examiner

*Primary Examiner*—Robert E. Pezzuto
*Assistant Examiner*—Tramar Harper
(74) *Attorney, Agent, or Firm*—Thomas E. Hilbun; Gordon & Rees LLP

(57) ABSTRACT

A game using 4 die, 3 are icosahedrons and 1 is a cube. The icosahedrons have a different consonant on each face of the die. The icosahedrons die has all the consonants of the English language represented except for the letter Y. The cube has a different vowel on each face of the die. The cube die has all the vowels of the English language represented including the letter Y. The dice provide a randomness of letters in order to challenge someone's word forming ability and includes the element of chance.

13 Claims, 3 Drawing Sheets

CONSONANT PAIN

BACKGROUND OF THE INVENTION

This game relates to word games. More specifically, it relates to a game combining chance and mental wherewithal.

SUMMARY OF INVENTION

The primary object of the invention is to develop word and/or language skills.

Another object is to combine chance and strategy in developing the stated skills.

A third object is to provide challenging entertainment for 1 to multiple players.

DETAILED DESCRIPTION OF THE INVENTION

Figure 1:
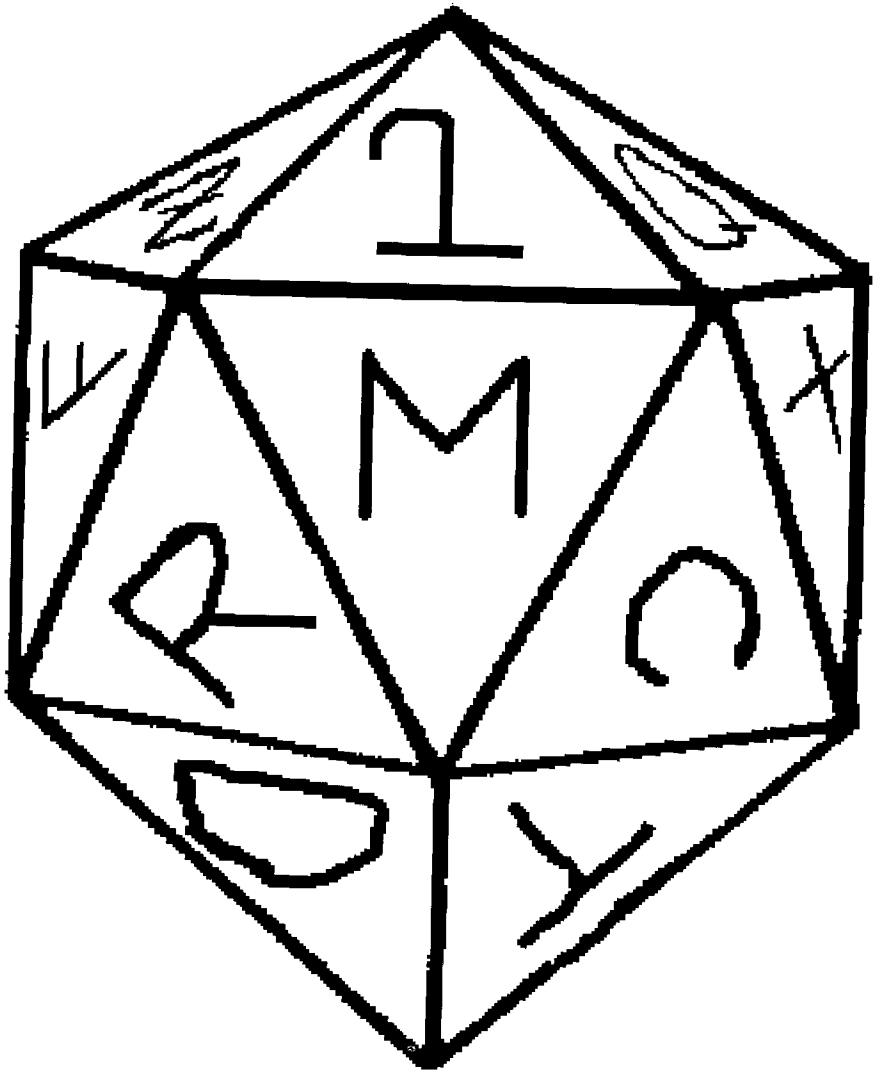
FIG. 1 is a perspective view of the 20-sided die (consonant die)
Figure 2:
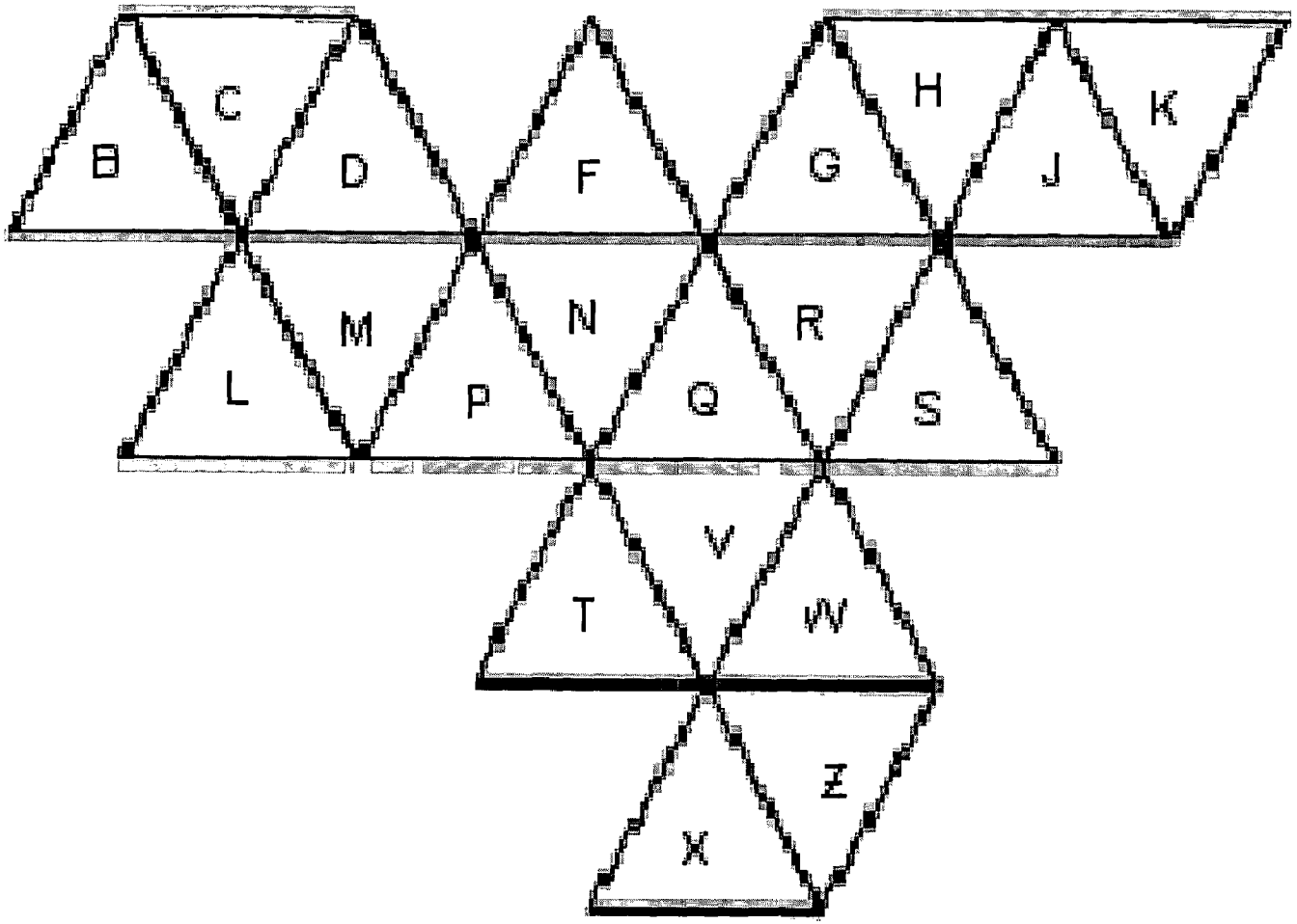
FIG. 2 is a diagram of the faces of the 20-sided die (consonant die)
Figure 3:
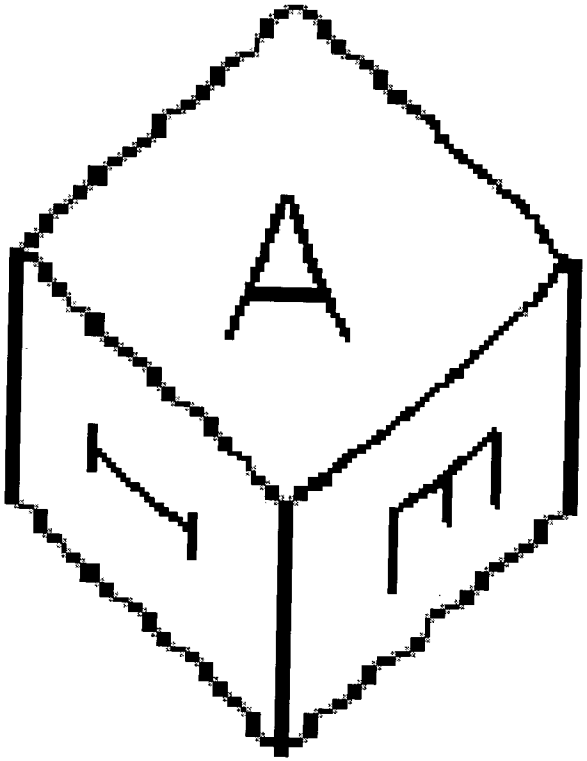
FIG. 3 is a perspective view of the 6-sided die (vowel die).

The present invention is comprised of a set of die, three 20-sided (icosahedrons) die and one 6-sided (cube) die. With this set of die, there are various games that can be created, such as the formation of phrases, sentences, or acronyms. However, this embodiment will focus on word formation.

The icosahedrons have one different consonant on each face of the die. All are on the die except for Y. The cube has 1 different vowel on each face including the letter Y. So, for purposes of the game, Y is always a vowel and never a consonant. The 3 die with the consonants on it (consonant die) are rolled to provide random letters in which words (or phrases or sentences or acronyms) are to be formed. Points can be scored based on if the word formed is actually a word, the length of the word, if the word formed is based on some sequence order of reading the die, etc., all within a time limit. Additional points can be added if the die with the vowels on it (vowel die) is used. This can provide an element of chance or increase the difficulty of forming a word with that particular vowel in it. An example:

An H, T and R are rolled with the consonant dice. Many words can be formed from those letters: heater, theatre, healthier, hooter, sheetrock, shelter, etc. Roll the vowel die and the letter U comes up. Now the task is a little harder to form a word with the letters H, T, R and now U. One word that could be formed is the word shouter but it took a lot longer to come up with it. Or you could use the vowel die to gamble for extra points. You form a word from the consonants H, T and R. That word is healthier. For bonus points, you roll the vowel die hoping that a vowel comes up that is used in the word healthier. You have a 1 in 2 (50%) chance of getting an A, E or I.

Pretty simplistic! You can see that there can be all kind of rules and variations to this game that can be implemented. For example, some letters in certain combinations cannot be made into words. Letters such as J, Q or X can make word formation difficult. You could designate some letters as wild cards, making the game more fun and unpredictable. Another example is to have the dice read in a certain order. Points can be based on whether a word is formed in sequence order, reverse order or random order. To determine the order the dice are read, the dice could be color coded or numbered or thrown one at a time.

The following is one variation of the games that can be constructed by using the dice. Players take turns in rolling the three 20-sided dice (consonant dice). Player must make a word using the consonants that end face up. Words are formed by adding any additional consonants or vowels, as needed, to make a complete word. And, there is a time limit, usually one minute, to form a word. Points are scored on whether the consonants in the word are used in sequence order of the dice (1,2,3), reverse order (3,2,1) or random order (2,3,1 or 3,1,2 or 1,3,2 or 2,1,3) and by the length of the word (the longer the word, the more points). The sequence can be determined by the color of the dice (ex. red=die 1, white=die 2, blue=die 3) or some other means. The vowel dice can be thrown in as a factor. If a player likes to gamble, or is behind in points and needs to catch up in a hurry, the player may use the vowel die. Points vary depending on whether a player declares the use of the vowel die before the consonant dice are rolled or after. The vowel dice is always rolled after the consonant dice. Challenges are also are part of the game and can keep a player from adding points to his total. Any player can challenge if a word is actually a word, based upon an agreed upon reference (such as a dictionary) and can include proper nouns. They can also challenge a player to spell the word. To win, a player must hit on a predetermined point target (such as 100 points).

Points Scoring:

For a word in sequence order—10 pts.

For a word in reverse order—5 pts.

For a word in random order—1 pt.

For each additional letter over 4 letters—1 pt. ea.

Unsuccessful challenges—5 pts deducted from challengers' point total.

Use of Vowel Die:

Rolling the vowel die can add bonus points or deduct points from a players total. In order to gain points, a player rolls the vowel die after he rolls the consonant dice and forms a word. If the vowel die comes up with a letter that is in the player's word, they get bonus points. If not, points are deducted.

If a player declares that he intends to roll the vowel die before he rolls the consonant dice, the points are awarded as follows:

For a word in sequence order—an additional 30 pts.

For a word in reverse order—an additional 20 pts.

For a word in random order—an additional 15 pts.

Unsuccessful roll—deducts 10 pts.

If a player decides to roll the vowel die after he rolls the consonant dice, the points are awarded as follows:

For a word in sequence order—an additional 20 pts.

For a word in reverse order—an additional 15 pts.

For a word in random order—an additional 10 pts.

Unsuccessful roll—deducts 5 pts.

Variations can be added to the game. An example, a letter(s) can be designated as a wild card(s). Another example, if an x is rolled, the player can substitute the letters cks and it would count as long as the spelling was correct. Other variations: ph=f, kw=q, z=sh An example of the game with 4 players:

First player rolls a P D T. The player comes up with the word "podiatry". Points scored—10+4=14. Second player rolls an L G Q. The player can't form a word within the time limit and receives 0 points. Third player declares he will use the vowel die and rolls the consonant dice for a J B R. The player comes up with "jabber", scoring 10+2=12 points. The player then rolls the vowel die and rolls an O. Since O is not in his word, he deducts 5 points for a total of 12−5=7 points. The fourth player then rolls the consonant dice for a K R B. The player forms the word "brick" for a total of 5=1=6 points. Back to the first player, he rolls an L P F. He forms the word "lapfer" for 10+2=12 points but is challenged by another player. The word "lapfer" is not in the reference guide and the first player ends up with 0 points. Now the second player rolls again. The player rolls a J X N. The player forms the word "Jackson" for a total of 10+3=13. The player then decides to roll the vowel dice for additional points. An A is rolled and the player is awarded bonus points of 20, bringing the total of points to 13+20=33. The game continues to a predetermined goal of 100 points. The third turn is up and he has 97 points. The player needs 3 points to win the game with 100 points. The third player rolls an M T P comes up with the word "temple". The player scores 1+2=3 and wins the game.

I claim:

1. A method of playing a word game, the game comprising:

rolling a first 20-sided die first, displaying a first consonant on top;

rolling a second 20-sided die second, displaying a second consonant on top;

rolling a third 20-sided die third, displaying a third consonant on top, wherein each 20-sided die has all twenty English alphabet consonants except for Y, one consonant on each side;

forming a word using all three consonants displayed by the three 20-sided die; and awarding points based on the sequence in which the consonants in the formed word occur.

2. The method of claim 1 wherein 10 points are awarded if the consonants in the formed word occur in the same order as the three 20-sided die were rolled.

3. The method of claim 1 wherein 5 points are awarded if the consonants in the formed word occur in a reverse order from the order in which the three 20-sided die were rolled.

4. The method of claim 1 wherein 1 point is awarded if the consonants in the formed word occur in a random order from the order in which the three 20-sided die were rolled.

5. The method game of claim 1 farther comprising:

rolling a 6-sided die with all six English alphabet vowels, including Y, one vowel on each side; and awarding points if the formed word contains the vowel displayed by the six-sided die.

6. The method of claim 5 wherein bonus points are awarded if a player declares intent to use the 6-sided die before rolling the set of three 20-sided die.

7. The method of claim 1 further comprising:

rolling a 6-sided die with all six English alphabet vowels, including Y, one vowel on each side; and deducting points if the formed word does not contain the vowel displayed by the six-sided die.

8. The method of claim 7 wherein extra points are deducted if a player declares intent to use the 6-sided die before rolling the set of three 20-sided die.

9. The method of claim 1 wherein certain letters can be used as wild cards.

10. The method of claim 1 wherein phonetically identical substitute consonant combinations can be used in place of a displayed consonant.

11. The method of claim 1 further comprising:

a first player challenging the spelling of a word formed by a second player; and not awarding points to the second player if the word formed by the second player is spelled incorrectly.

12. The method of claim 1 further comprising a first player challenging the spelling of a word formed by a second player; and deducting points from the first player if the word formed by the second player is spelled correctly.

13. The method game of claim 1 further comprising awarding points based on the length of the word.

* * * * *